US009278734B2

(12) United States Patent
Pennington

(10) Patent No.: US 9,278,734 B2
(45) Date of Patent: Mar. 8, 2016

(54) TETHER DEVICE FOR POOL FLOATS

(71) Applicant: Michael Pennington, Davenport, FL (US)

(72) Inventor: Michael Pennington, Davenport, FL (US)

( * ) Notice: Subject to any disclaimer, the term of this patent is extended or adjusted under 35 U.S.C. 154(b) by 0 days.

(21) Appl. No.: 14/690,898

(22) Filed: Apr. 20, 2015

(65) Prior Publication Data

US 2015/0336639 A1 Nov. 26, 2015

Related U.S. Application Data

(60) Provisional application No. 62/001,863, filed on May 22, 2014.

(51) Int. Cl.

| | |
|---|---|
| ***B63B 21/24*** | (2006.01) |
| ***B63B 21/29*** | (2006.01) |
| ***B63B 35/85*** | (2006.01) |

(52) U.S. Cl.

CPC ..... *B63B 21/29* (2013.01); *B63B 35/85* (2013.01)

(58) Field of Classification Search

CPC ..... B63B 21/24; B63B 21/29; B63B 21/50; B63B 2021/24; B63B 2021/50; B63B 35/85; B63B 2035/85

See application file for complete search history.

(56) References Cited

U.S. PATENT DOCUMENTS

| | | | | |
|---|---|---|---|---|
| 7,690,319 | B2 * | 4/2010 | Wingate | B60P 7/0823 114/218 |
| 8,327,788 | B1 * | 12/2012 | Cardarelli | B63B 21/54 114/221 R |
| 8,794,170 | B2 * | 8/2014 | Eppen | B63B 21/22 114/230.24 |
| 2011/0146558 | A1 * | 6/2011 | Korell | B63B 21/00 114/230.26 |
| 2013/0167765 | A1 * | 7/2013 | Eppen | B63B 21/22 114/230.26 |

* cited by examiner

*Primary Examiner* — Daniel V Venne

(74) *Attorney, Agent, or Firm* — Jason T. Daniel, Esq.; Daniel Law Offices, P.A.

(57) ABSTRACT

A tether device for pool floats includes a float attachment unit having an elongated cord with connectors permanently affixed to each end. A soft sleeve is positioned along the cord and between the connectors. The device also includes an anchor unit having a tether that is interposed between a weighted element and a hook.

20 Claims, 3 Drawing Sheets

TETHER DEVICE FOR POOL FLOATS

CROSS-REFERENCE TO RELATED APPLICATIONS

This application claims the benefit of U.S. Application Ser. No. 62/001,863 filed on May 22, 2014, the contents of which are incorporated herein by reference.

FIELD OF THE INVENTION

The present invention relates generally to pool and beach floats, and more particularly to a weighted tether for use with the same.

BACKGROUND OF THE INVENTION

Whether lounging in a backyard pool or taking a swim at the beach, pool floats are among the most common devices used by recreational swimmers. Whether the float is in the form of an inflatable inner tube or a foam lounger, swimmers and beach-goers alike utilize these extremely lightweight and portable floats for a variety of waterborne activities.

However, owing to their lightweight construction, many floats are extremely vulnerable to wind and currents when they are in the water. This is particularly true when the float is in open bodies of water such as the ocean, lakes and rivers, for example. As a result, it is not uncommon for a user who is occupying the float to be forced to continuously swim or paddle, in order to remain in the same general area. This is undesirable in many cases as one of the primary uses of the float is to allow the user to relax. In addition to the above, when the user is not resting on the float, care must be taken to prevent it from drifting away. In this regard, users are often forced to carry the float out of the water, where it is out of sight, and hope that no one steals it.

Although there are known anchor devices for boats and other large craft, these devices are not suitable for use in the above described situation, as the shape and material of these anchors would easily tear the float fabric if and when contact between the two surfaces is made. Moreover, owing to the large size of traditional anchors, there is no way to easily store the devices together when one or both are not being utilized.

Accordingly, it would be beneficial to provide a tether device that can be secured to any type of pool float in order to maintain the same in a stationary position when in the water, and without suffering from the drawbacks of the above noted devices.

SUMMARY OF THE INVENTION

The present invention is directed to a tether device for pool floats. One embodiment of the present invention can include a float attachment unit having an elongated cord with connectors along each end. A sleeve is positioned along the cord, and functions to prevent the cord from damaging a pool float onto which the device is attached.

The device can also include an anchor unit having a tether, a weighted element and a hook. The hook can engage the connectors of the attachment unit in a releasable manner, and the weight can engage a bottom surface of a water environment to prevent movement of the float.

In another embodiment, the device can also include a tether adjustment unit that functions to increase and decrease a length of the tether, based on the instructions from a user.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
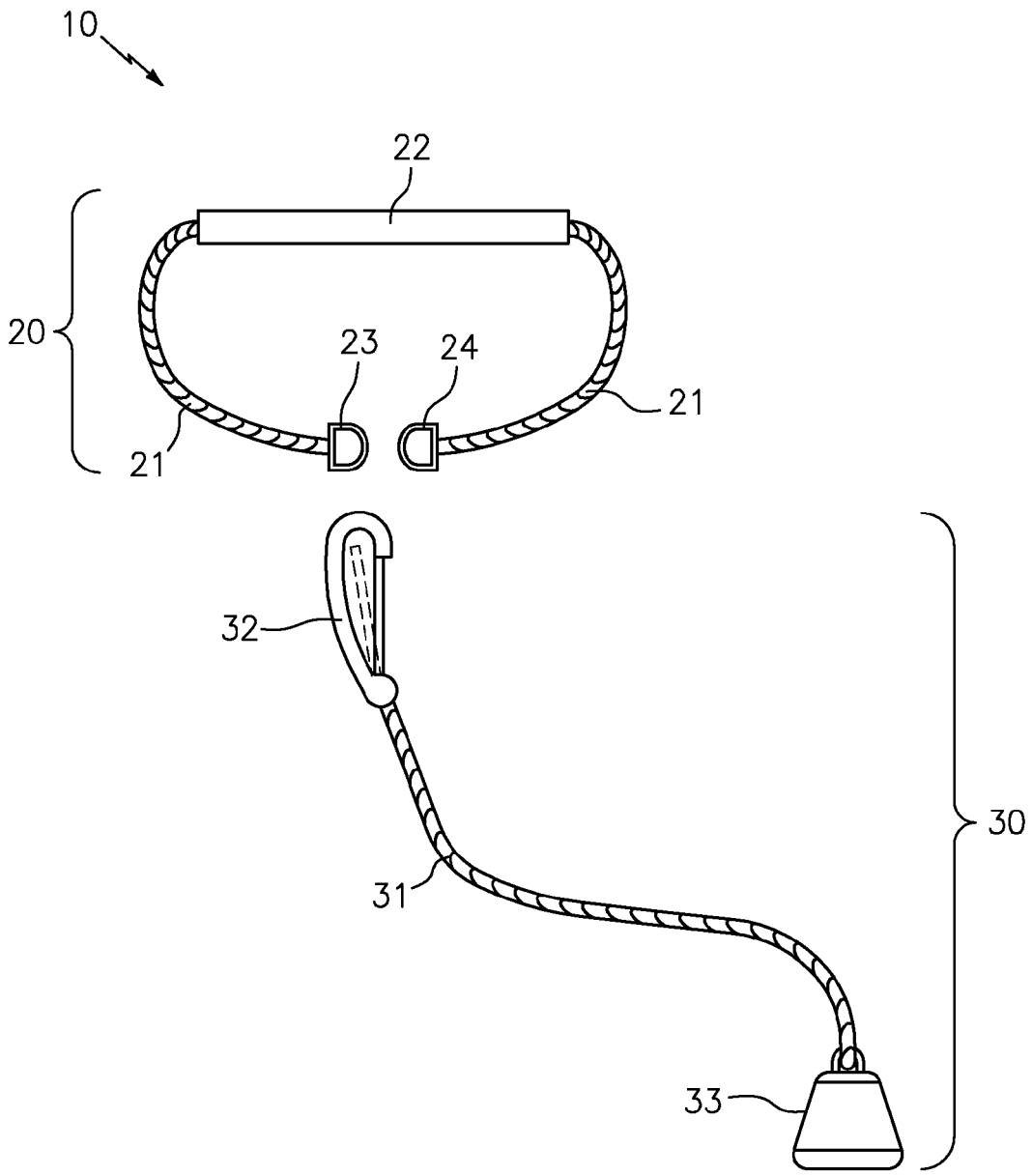
FIG. 1 is an exploded parts view of a tether device for pool floats that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As described herein, the term "pool float" and derivatives thereof are not to be construed as limited to a pool environment, as this term can refer to any device capable of floating on the surface of any body of water. Several nonlimiting examples include inflatable toys and floats, foam toys and floats, rafts and other such items. Additionally, the term "removably secured" shall be used to describe a situation wherein two or more objects are joined together in a non-permanent manner so as to allow the same objects to be repeatedly joined and separated.

FIG. 1 illustrates one embodiment of a tether device for pool floats 10 that is useful for understanding the inventive concepts disclosed herein. As shown, the device 10 can include, essentially, a float attachment unit 20 and an anchor unit 30.

The float attachment unit 20 can function to secure the device 10 onto a pool float 5. In one embodiment, the float attachment unit 20 can include an elongated cord 21 having a sleeve 22 disposed along a middle section thereof, and a pair of connectors 23 and 24 that are disposed along each end. The cord 21 can include any number of different lengths, diameters and construction materials. In the preferred embodiment, the cord 21 can include a length of between approximately 2 and 4 feet, and can be constructed from a 400 lb monofilament fishing line that is coated with plastic. Of course, any number of other construction materials such as nylon rope, and/or elastomeric materials are also contemplated.

The connectors 23 and 24 can be permanently affixed onto the ends of the cord 21 in accordance with known manufacturing processes. In the preferred embodiment, the connectors can include metal rings that are covered with a plastic or rubber coating, so as to be nonabrasive when making contact with the float. Of course, any number of other shapes and construction materials are also contemplated.

The sleeve 22 can function as a barrier between the cord 21 and the float onto which the device 10 is to be used. In this regard, the sleeve can include an elongated, generally hollow member having an internal diameter that is suitable for receiving the cord 21. The sleeve can extend along a portion of the cord body, or can extend along the entire length of the cord body so as to be adjacent to the connectors along each end. The sleeve can include any number of different shapes sizes and dimensions, and in one embodiment, the sleeve can be constructed from soft and generally flexible material such as lightweight plastic or foam tubing, for example. Of course, any number of other materials such as semi-rigid fiberglass or plastic, for example, are also contemplated.

The anchor unit 30 can be removably connected to the attachment unit 20 and can function to provide an underwater anchor for maintaining a pool float in a stationary position. In one embodiment, the anchor unit 30 can include an elongated tether 31 having a hook 32 at one end, and a weighted element 33 at the other end. As described herein, the tether 31 can include any number of different lengths and diameters. In one embodiment, the tether 31 can include a length of between 10 and 15 feet that is constructed from 400 lb monofilament fishing line that is coated with plastic. Of course, any number of other lengths and materials such as nylon rope, for example, are also contemplated.

The hook 32 can function to removably secure the tether 31 to the attachment unit 20. In this regard, the hook can preferably include a plastic coated carabiner, D-ring or other such clasp which can transition between an open and closed state in order to physically engage each of the connectors 23 and 24 described above.

The weighted element 33 can function as an anchor which can be dropped into the water when the float is at a desirable location. In this regard, the weighted element 33 can include a sufficient mass that can counteract the wind and/or water currents attempting to move the float away from the desired position. In one embodiment, the weighted element 33 can be constructed from a smooth sided 20 or 32 oz lead drop sinker that is permanently secured onto the end of the tether 31. Moreover, it is preferred that the lead sinker also be coated with plastic, in order to provide a generally soft surface which can be in direct contact with a foam or inflatable float, and without causing damage to the same.

Although described as including lead construction and a particular weight, this is for illustrative purposes only, as any number of other materials and weights, such as steel, for example, that are suitable for long term exposure to water are also contemplated.

Figure 2:
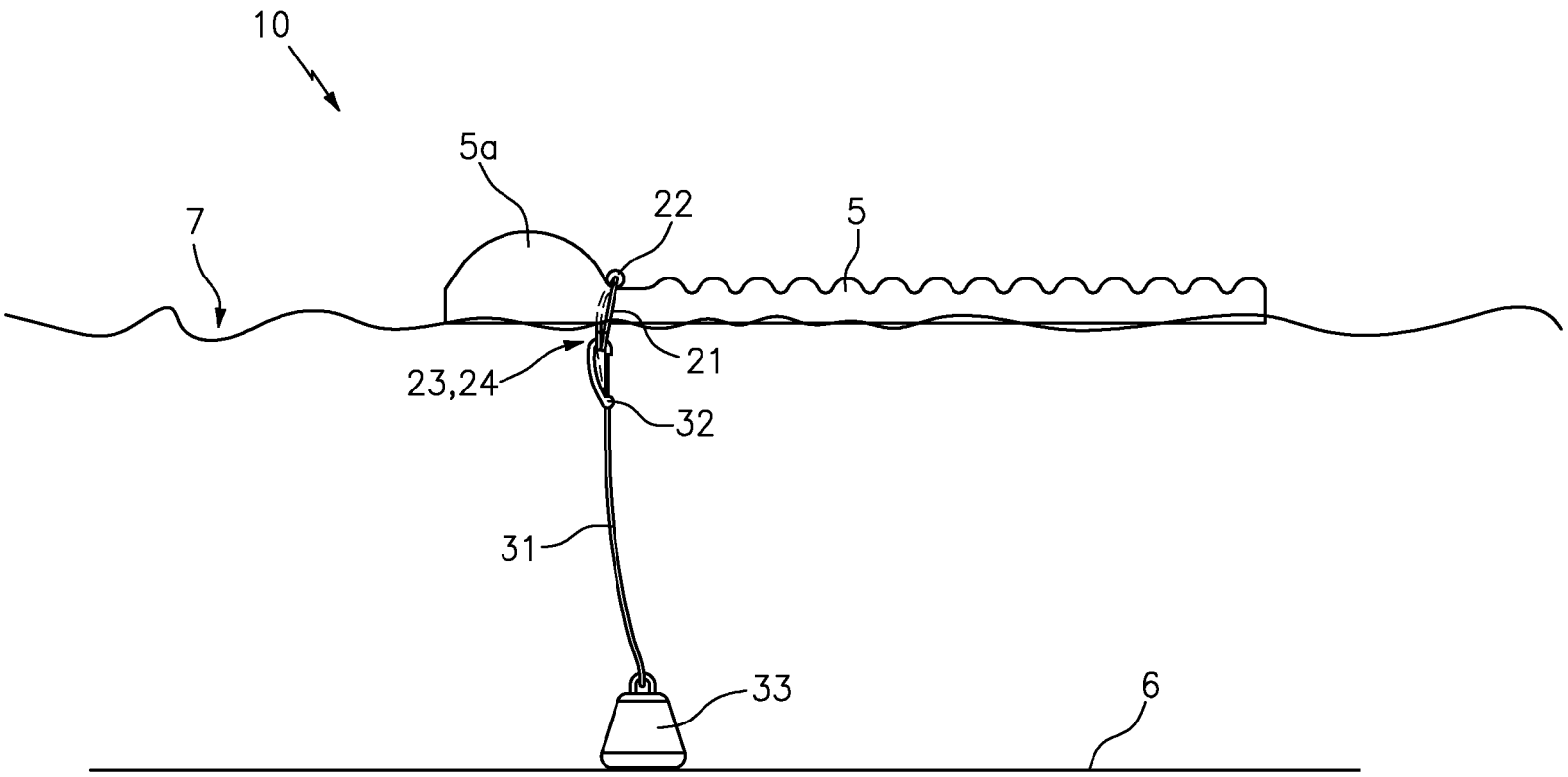
FIG. 2 is a side view of the tether device for pool floats in operation, in accordance with one embodiment of the invention.

FIG. 2 illustrates one embodiment of the tether device for pool floats 10 in operation. As shown, the cord 21 of the float attachment unit can be secured around the main body of the float 5. In the preferred embodiment, the sleeve 22 can be positioned along the top surface of the float, and can function to prevent the downward pull of the cord 21 from damaging the float material. Moreover, by providing a soft sleeve 22, both the cord and sleeve can bend and conform to the changing shape of the float when in use. As such, the sleeve can be positioned between the body of a user lying on the float, and the float surface, without creating a raised area that would be uncomfortable to the user. Additionally, the sleeve 22 can be positioned against the pillow or other raised section of the float 5*a*, so as to not be noticeable to a user lying on the float.

By providing a cord and tether that are made from plastic coated monofilament line, the device can be extremely lightweight and easy to move, while maintaining excellent tensile strength. As such, the device can be utilized in virtually any water condition without fear of breaking. Moreover, owing to the small stature of such lines, the cord and tether can be coiled to an extremely small size so as to be easily stored with the float when not in use.

Figure 3:
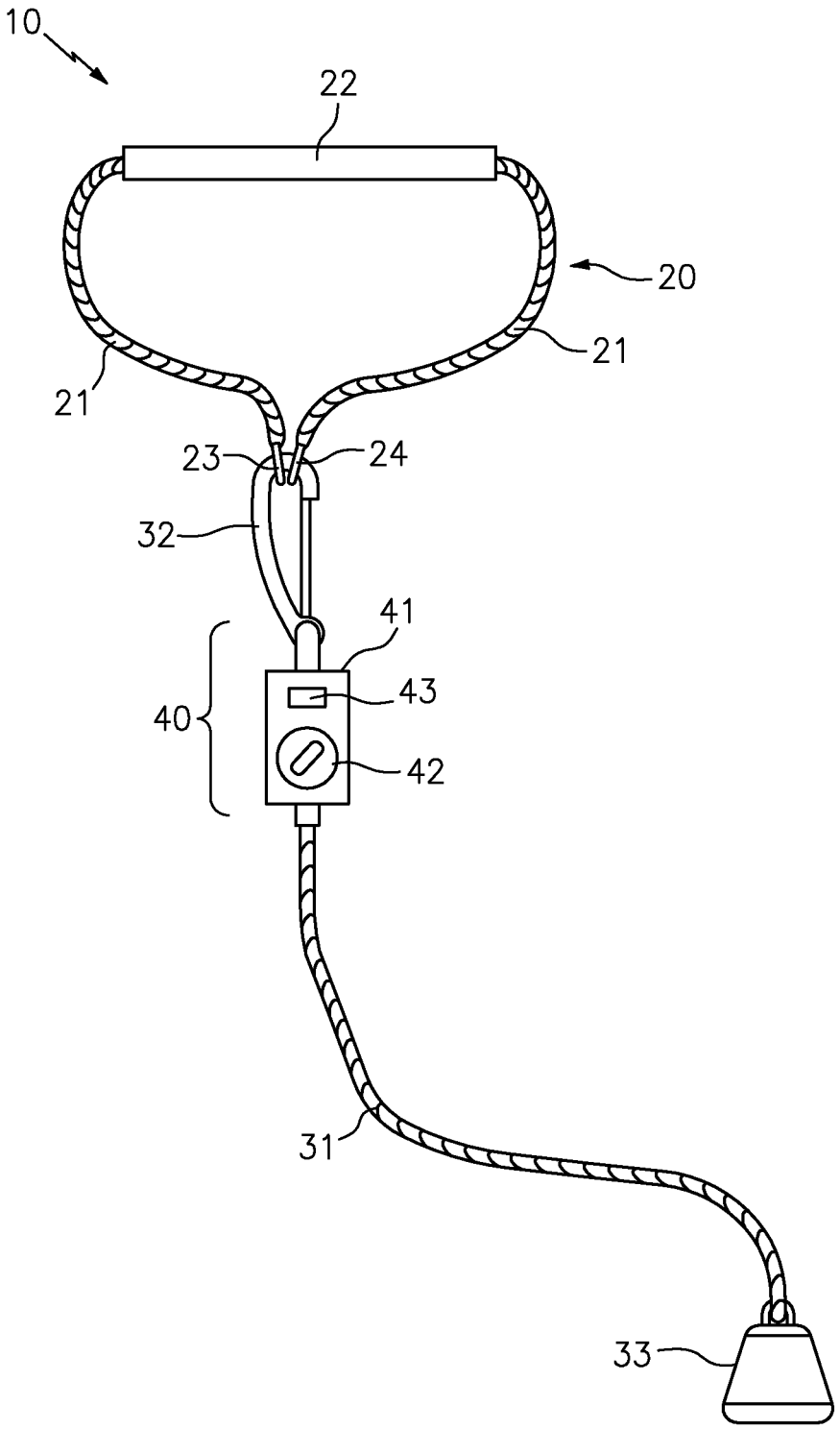
FIG. 3 is a front view of the tether device for pool floats in operation, in accordance with another embodiment of the invention.

FIG. 3 illustrates an another embodiment of a tether device for pool floats 10 that further includes a tether adjustment unit 40 having a main body 41, an internal reel, a reel handle 42 and a locking mechanism 43.

As shown, the adjustment unit 40 can preferably be located adjacent to the hook 32 and can function to adjust a length of the elongated tether 31. As described herein, the internal reel can include a generally circular member which can be in contact with one end of the tether 31. In this regard, the reel can function to wind the tether within the main body 41, thereby reducing a distance between the adjustment unit and the weighted element 33. Likewise, the reel can work in reverse, in order to lengthen the distance between the adjustment unit and the weighted element 33. The internal reel is connected to the reel handle 42, which can impart the mechanical force necessary to perform the reel winding and unwinding action. Finally, the locking mechanism 43 can function to prevent the reel from being operated, so as to ensure the length of the tether remains constant. When utilized with the reel unit, it is preferred that the tether include a length of between approximately 10 and 25 feet.

As described herein, one or more elements of the device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individual elements may be formed together as one continuous element, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A tether device for a pool float, said device comprising:
a float attachment unit that includes
an elongated cord having a first end, a second end and a middle section,
a pair of connectors that are permanently secured along each of the first and second ends, and
a sleeve that is disposed along the middle section; and
an anchor unit that includes
a hook having a moveable portion that transitions between an open and a closed orientation,
a weighted element having a plurality of sides and a mass, and
an elongated tether that is interposed between the hook and the weighted element,
wherein the anchor unit is removably secured to the attachment unit via the hook and connectors, respectively.

2. The device of claim 1, wherein the elongated cord is constructed from a 400 lb monofilament fishing line that is coated in plastic.

3. The device of claim 2, wherein the elongated cord includes a length of between approximately 2 feet and 4 feet.

4. The device of claim 3, wherein the connectors are constructed from metal that is coated with at least one of plastic and rubber, and each of the connectors are permanently affixed to the elongated cord.

5. The device of claim 4, wherein the sleeve is constructed from a generally flexible material and functions to flex in complete conformity with a shape of a float.

6. The device of claim 4, wherein the sleeve is constructed from a semi-rigid material and functions to flex slightly with a shape of a float.

7. The device of claim 1, wherein the tether is constructed from a 400 lb monofilament fishing line that is coated in plastic.

8. The device of claim 7, wherein the tether includes a length of between approximately 10 feet and 15 feet.

9. The device of claim 8, wherein the hook consists of a carabiner.

10. The device of claim 9, wherein the hook consists of a D-ring.

11. The device of claim 8, wherein the weighted element is permanently secured along one end of the tether, and includes a lead sinker having a weight of between approximately 20 ounces and 32 ounces.

12. A tether device for a pool float, said device comprising:
a float attachment unit that includes
an elongated cord having a first end, a second end and a middle section,
a pair of connectors that are permanently secured along each of the first and second ends, and
a sleeve that is disposed along the middle section; and
an anchor unit that includes
a hook having a moveable portion that transitions between an open and a closed orientation,
a tether adjustment unit that is positioned along a bottom end of the hook,
a weighted element having a plurality of sides and a mass, and
an elongated tether that is interposed between the reel unit and the weighted element,
wherein the anchor unit is removably secured to the attachment unit via the hook and connectors, respectively, and
the reel unit functions to adjust a length of the tether.

13. The device of claim 12, wherein the tether is constructed from a 400 lb monofilament fishing line that is coated in plastic.

14. The device of claim 13, wherein the tether includes a length of between approximately 10 feet and 25 feet.

15. The device of claim 13, wherein the tether adjustment unit includes a reel handle for increasing and decreasing the length of the tether; and
a locking mechanism that functions to prevent movement of the handle in order to keep the tether at a fixed length.

16. The device of claim 15, wherein the hook consists of a carabiner.

17. The device of claim 16, wherein the weighted element is permanently secured along one end of the tether, and includes a lead sinker having a weight of between approximately 20 ounces and 32 ounces.

18. The device of claim 12, wherein the elongated cord is constructed from a 400 lb monofilament fishing line that is coated in plastic, and includes a length of between approximately 2 feet and 4 feet; and
wherein the connectors are constructed from metal that is coated with at least one of plastic and rubber, and each of the connectors are permanently affixed to the elongated cord.

19. The device of claim 18, wherein the sleeve is constructed from a generally flexible material and functions to flex in complete conformity with a shape of a float.

20. The device of claim 18, wherein the sleeve is constructed from a semi-rigid material and functions to flex slightly with a shape of a float.

* * * * *